US006534700B2

(12) United States Patent
Cliff

(10) Patent No.: US 6,534,700 B2
(45) Date of Patent: Mar. 18, 2003

(54) AUTOMATED COMPILATION OF MUSIC

(75) Inventor: David Trevor Cliff, Bristol (GB)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 10/132,268

(22) Filed: Apr. 26, 2002

(65) Prior Publication Data

US 2002/0157522 A1 Oct. 31, 2002

(30) Foreign Application Priority Data

Apr. 28, 2001 (GB) ..... 0110444

(51) Int. Cl.[7] ..... G10H 1/46; G10H 7/00

(52) U.S. Cl. ..... 84/603; 84/633; 84/639; 381/104; 381/118; 381/120

(58) Field of Search ..... 84/601–608, 622–625, 84/633, 639, 640, 641, 642, 741, DIG. 29; 381/104–109, 118–121

(56) References Cited

U.S. PATENT DOCUMENTS 5,418,321 A * 5/1995 Keller et al. ..... 84/633 X
5,548,655 A * 8/1996 Takahashi ..... 381/104
5,802,187 A * 9/1998 Hsu ..... 381/104 X

* cited by examiner

*Primary Examiner*—Stanley J. Witkowski

(57) ABSTRACT

During mixing of two musical tracks, the variations in combined output volume are reduced by analyzing either the intrinsic amplitude at which each track was mastered or the output amplitude (i.e. subsequent to amplification of the audio signal), and modifying either the intrinsic amplitude or amplification during the mixing phase. Musical clashes during mixing are avoided by analyzing intrinsic amplitudes of the two tracks at similar frequencies to detect the likelihood of a clash, and in the event a clash is detected, reducing the output amplitude of one of the tracks at the relevant frequency.

29 Claims, 8 Drawing Sheets

AUTOMATED COMPILATION OF MUSIC

The present invention relates to the automated compilation of pieces of musical content, usually referred to as "tracks", and more particularly, to compilation in which one track is phased in over the top of another, preferably in a manner providing an apparently seamless transition between tracks. This is known in current vernacular as "mixing".

Our co-pending UK application (HP docket 30001926) discloses, inter alia, a system and method for the automated compilation of tracks which are typically stored as digital audio, such as on compact disc. In this system, the outputs of two digital audio players are fed to an output, such as a set of speakers. The speed at which tracks from the two CD players are played is adjusted, so that the beat of an incoming track is matched to the speed of a track currently playing (known as "time stretching"), and once this has been achieved an automated cross-fading device reduces the output volume of the current track while increasing the output volume of the incoming track, thereby to provide a seamless transition between them.

A first aspect of the present invention addresses the issue of amplification of each of the tracks during the transition phase from one track to another, or "cross-fade". In an automated system, in order to try to provide a seamless transition between tracks, amplification of the outgoing track will typically be reduced at the same rate as the amplification of the incoming track is increased, with the reduction and increase in amplification starting at the same time. Frequently tracks are mixed so that the incoming track is faded in over the end of the outgoing track, as a result of which the volume on the outgoing track may well be reducing, since many dance tracks end simply by fading out the volume to zero, or start by fading in the volume from zero (i.e. the intrinsic amplitude or "mastered volume" of the recording is reduced to zero, or increased from zero, as the case may be). In such a situation, unless the fade-out rate of the intrinsic amplitude (and thus for a constant level of amplification, the volume) at the end of the outgoing track matches the fade-in rate of the intrinsic amplitude at the beginning of the incoming track, and both are in turn matched with the rate of cross-fading the amplification from one track to another, the transition between the tracks will be subject to a variation in volume which is undesirable, since it disturbs the seamless transition between incoming and outgoing tracks.

Accordingly, a first aspect of the present invention provides a method for the automated mixing of at least two pieces of musical content comprising the steps of:

- selecting first and second sections of first and second tracks respectively, over which transition between playing the first and second tracks will be made;
- sampling intrinsic recorded amplitude of the first and second tracks over the first and second sections respectively;
- simultaneously playing the first and second sections of the first and second tracks;
- effecting transition from playing the first track to playing the second track by reducing output volume of the first track over duration of the first section and increasing output volume of the second track over duration of the second section; and
- using sampling of the intrinsic amplitude of at least one of the first and second tracks to equalise variations in net output volume from the first and second tracks over the duration of the transition.

Equalisation of variations in recorded amplitude may result merely in a reduction in variations of net output volume in comparison to what would otherwise be the case, or may result in a substantially constant net output volume, depending upon the extent of equalisation. Equalisation may be achieved typically either by altering the amplification of one or both tracks over the course of the transition, altering the intrinsic recorded amplitude of one or both tracks, or a combination of both techniques.

In one embodiment of equalisation by regulation of amplification for one or both of the tracks, a series of synchronous intrinsic amplitude values are sampled from each of the tracks, and contemporaneous values are then summed to determine the extent, if any, to which the combined intrinsic amplitude varies over the transition phase. The resultant variation in intrinsic amplitude is then used to generate an amplification profile which is then applied proportionally to one or both the tracks during the transition to equalise the net output volume. Equalisation by modification of intrinsic amplitude may use the contemporaneous summed amplitude values to generate discrete error values by which summed amplitude should be altered in order to maintain a constant value over the transition phase.

In an alternative embodiment amplification or intrinsic amplitude modification is used to configure predetermined sections of tracks to predetermined introduction and playout template profiles of amplitude against time, so that any two tracks conforming to the profile (either by variation in amplification or intrinsic amplitude) may be mixed together.

In yet a further embodiment an indication of variation in combined amplitude is generated for a plurality of temporal juxtapositions of two tracks, and the temporal juxtaposition having the lowest indicated variation is selected.

Typically, the equalisation will be performed on the basis of the sampling of the intrinsic amplitude in a particular frequency range determined as dominant, and this will in turn typically be determined on the basis of the frequency of the beat used for time stretching the incoming track and outgoing tracks.

A second and independent aspect of the present invention is concerned with the musical elements present in the outgoing and incoming tracks, such as vocal lines, melodic instrument parts, or percussion signatures (from, e.g. snare drums, symbols or handclaps etc.). It is not unusual for such elements in the outgoing and incoming tracks to clash, even though the fundamental beats of the two tracks have been matched, and the volume of the two tracks has been equalised over the cross fade. The result of such a clash is that when these elements are heard together the result is an unappealing mix.

Accordingly, a second aspect of the present invention provides a method for automated mixing of first and second music tracks comprising the steps of:

- selecting first and second sections of the first and second tracks respectively, over which a transition between the first and second tracks will occur;
- for at least selected intrinsic peak amplitudes of the first track, determining, in accordance with at least one predetermined criterion, whether a musical clash exists with an intrinsic peak amplitude from the second track; and
- in the event of a clash, reducing output amplitude of at least one of the tracks at least at a frequency of one of the clashing intrinsic peak amplitudes, and over a time interval at least equal to duration of the aforesaid one of the intrinsic peak amplitudes.

The reduction in output amplitude (which will typically also be a reduction in output volume) of a given frequency band may again, as with the first aspect of the present invention, be implemented either via adjustment of amplification over at least the frequency of one of the clashing peak amplitudes (although this is only possible where the system provides for differing amplification levels for different frequency bands), or by copying at least the section of the track in question into addressable memory, and altering the intrinsic recorded amplitude levels for that frequency band.

Yet a further independent aspect of the present invention provides a method of mixing first and second tracks including the steps of:

analysing variations in amplitude with time and frequency for both tracks;

on the bas is of the analysis, defining at least one frequency band common to both tracks; and equalising output amplitude of the tracks in the frequency band during mixing from one track to another.

Thus the frequency band to be used in order to provide equalisation is defined on the basis of the musical characteristics of the tracks to be mixed, rather than using predetermined frequency bands which may not be appropriate having regard to the frequencies of the two tracks to be mixed.

Embodiments of the invention will now be described, by way of example, and with reference to the accompanying drawings, in which.

Figure 5B:
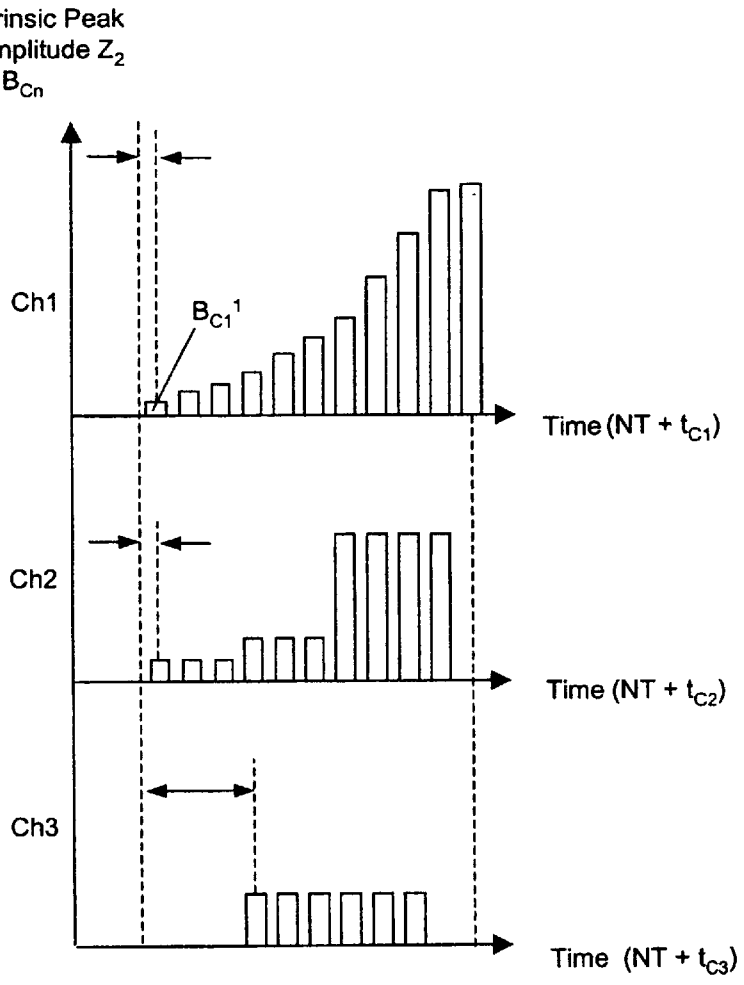
Figure 5A:
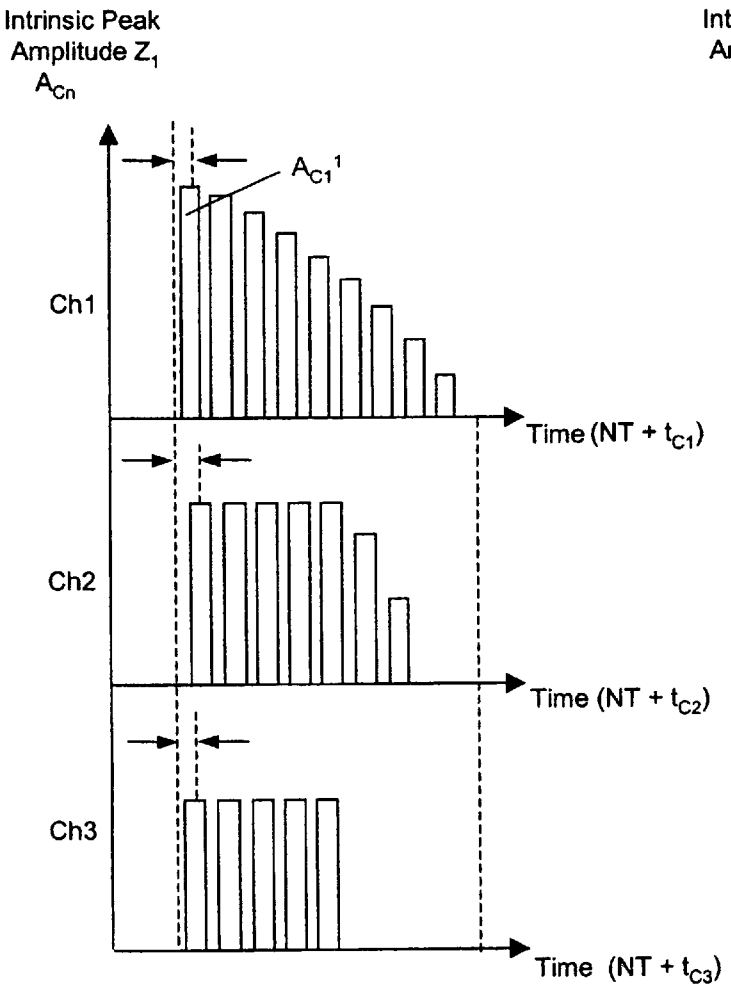
Figures 6A, 6B, 6C:
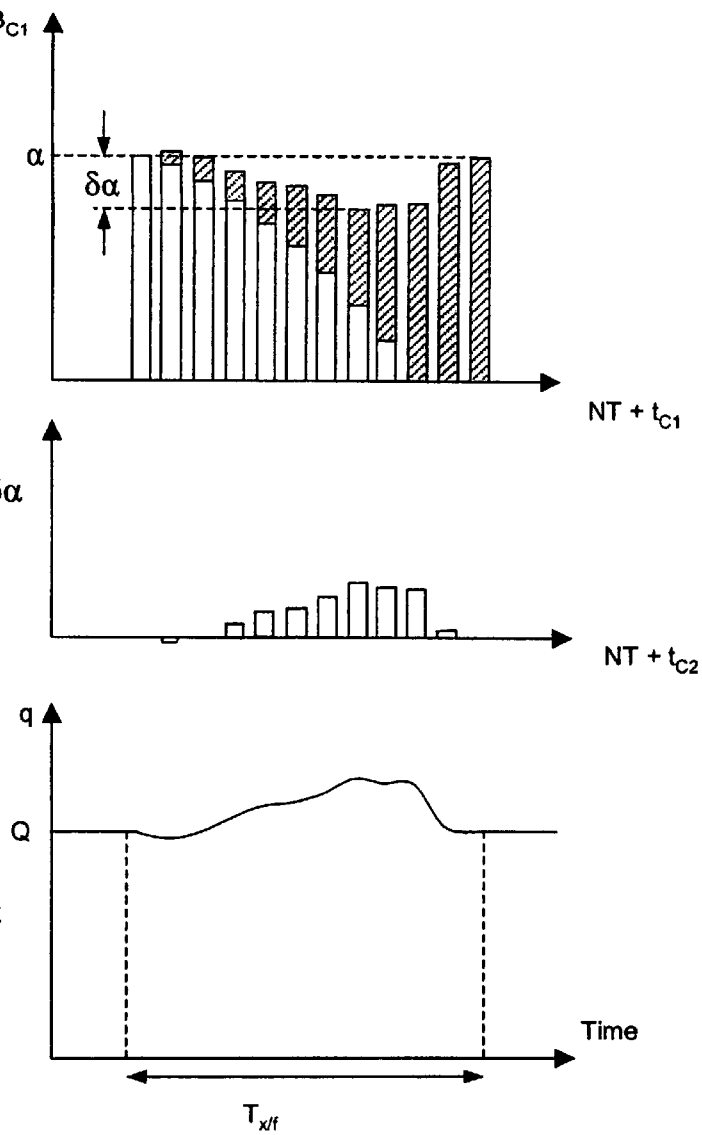
Figures 7A, 7B, 78C:
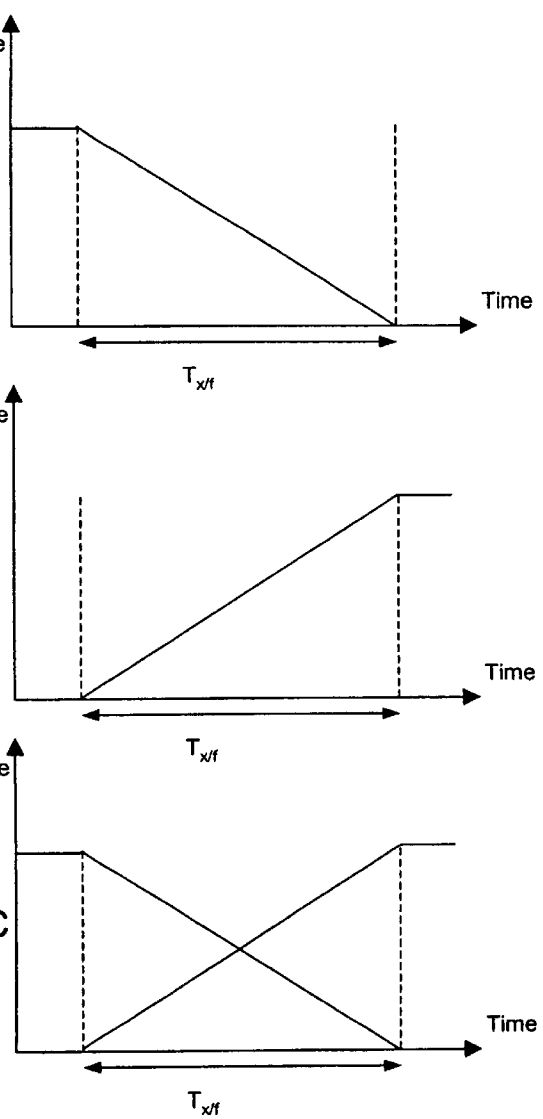
Figure 9A:
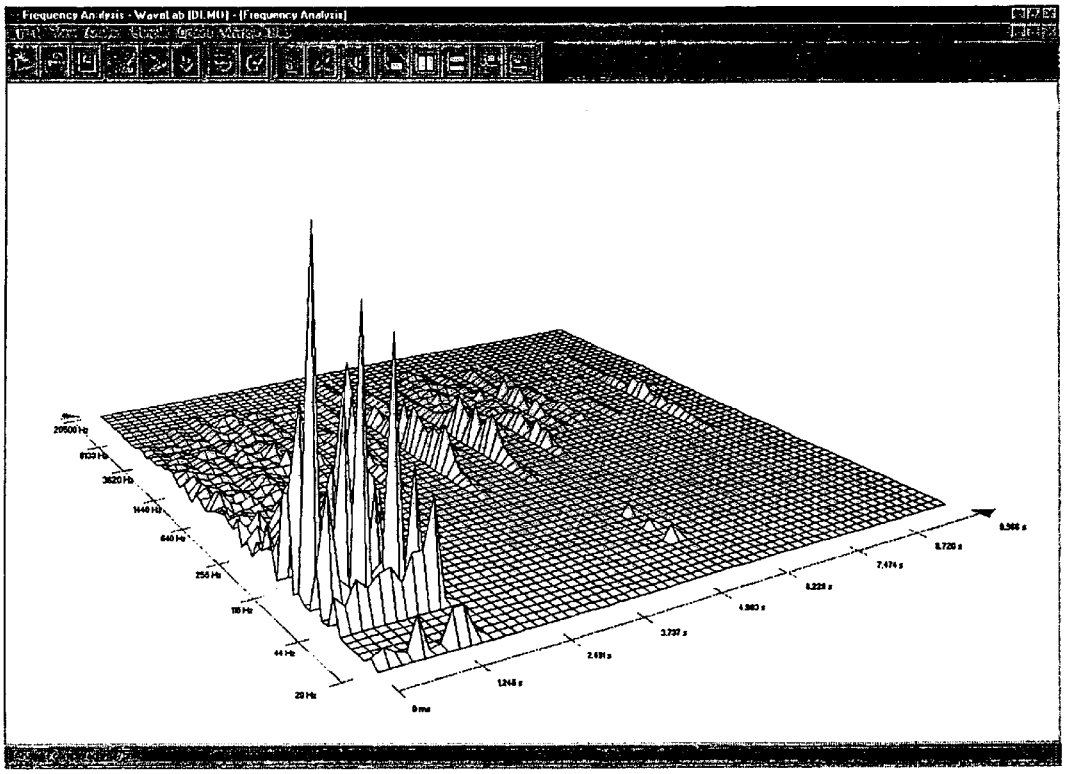
Figure 9B:
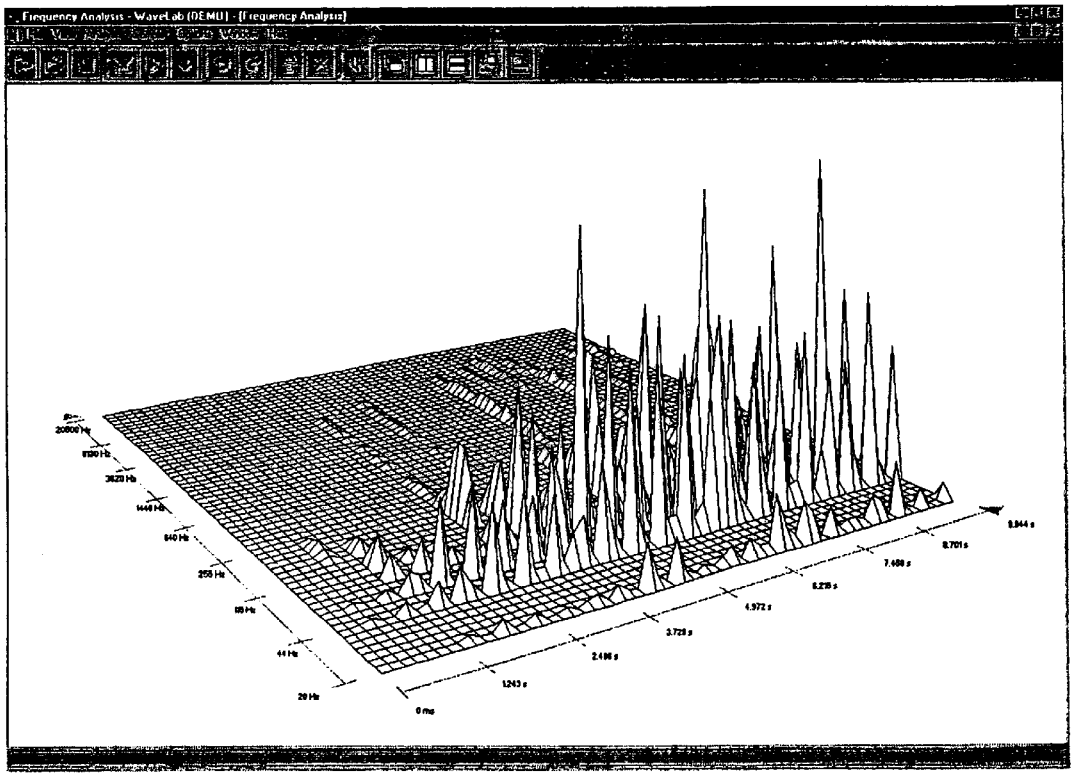
Figure 10:
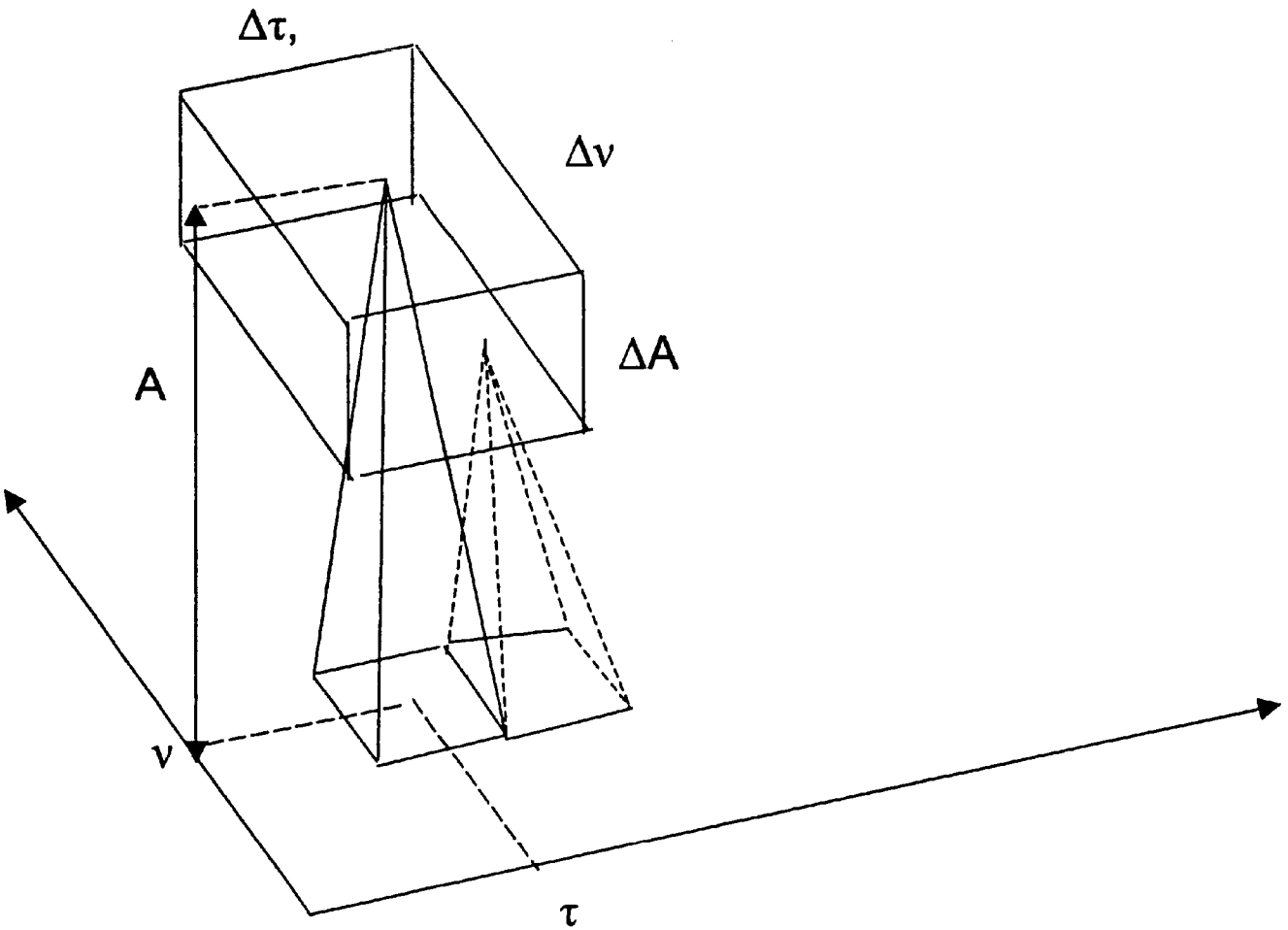

FIGS. 5A and B are graphs of variation in peak amplitude at different frequency bands of two tracks which are to be mixed;

FIGS. 6A to C are graphs illustrating a first type of processing of peak amplitude values for the purpose of equalising the net output volume;

FIGS. 7A to C are graphs showing generic intrinsic amplitude templates for the start and end of a track;

FIGS. 8A to D are graphs showing a further type of processing of peak amplitude values for the purpose of equalising the net output volume;

FIGS. 9A and B are graphs showing 3-dimensional mapping of amplitude against frequency and time for two mixed tracks; and FIG. 10 is an illustration of a manner in which clashes of frequency between mixed tracks may be avoided.

Figure 1:
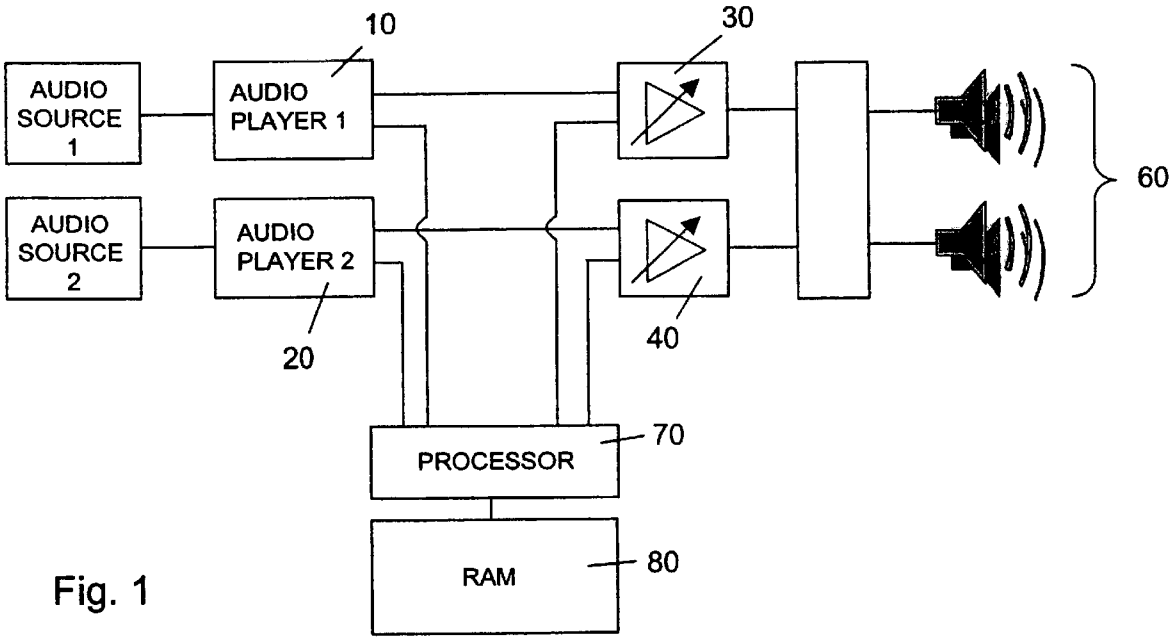
FIG. 1 is a schematic illustration of a mixing system for the compilation of music.

Referring now to FIG. 1, a system for mixing musical tracks includes a pair of audio players 10 and 20, which derive an audio signal (i.e. a signal which is amplifiable into sound) from audio sources AS1, AS2 respectively. In the case of manual mixing systems, audio players 10, 20 are typically turntables for playing vinyl records; this apparently anachronistic equipment being the equipment of choice for the majority of professional disc jockeys because it provides functionality not readily available with other formats of audio source material such as compact discs. In the present automated example the audio players 10, 20 are compact disc players which derive an audio signal from audio data (i.e. data from which an audio signal may be derived, but which is not directly amplifiable into sound) stored on audio sources in the form of CDs. The present invention may however be implemented using any format of audio player and source, provided that in the case of analogue players, where data processing is required, conversion to digital data is performed on the output of the audio players. The output of the audio players 10, 20 is passed through variable gain amplifiers 30, 40 respectively, whose outputs are then passed via a mixer 50 to a single set of loud speakers 60 (although individual sets of speakers may be provided for each of the amplifiers 30, 40 if desired). In a modification, the gain controls of the two variable gain amplifiers are linked, giving output into a single power amplifier; this gain-linking mechanism is known as a cross fader and is frequently used by professional DJs. The illustrated system is however preferred because of the additional flexibility which it offers. Additionally, a processor 70 is connected to the outputs of the audio players 10, 20, as well as the inputs of the amplifiers 30, 40, and the processor 70 is connected directly to a random access memory 80.

The illustrated system is operable to decrease or "fade out" the output volume (i.e. the amplitude of the output audio signal, which in this example is made manifest by the speakers 60) of one track from one of the audio sources, e.g. audio source 1, while simultaneously increasing or "fading in" the output volume from another track of audio source 2; ideally this is done in a manner providing a seamless mix between the outgoing and incoming tracks. The provision of such a seamless mix first of all requires that the beats of the outgoing and incoming tracks are matched. This is done by automatically regulating the speed at which one or both of the respective tracks are played, and synchronising the beats of the tracks. The automation of such a process is described in our co-pending European application (HP docket 30001926). Additionally, the output volume of each of the tracks must be regulated to ensure that there are no dramatic increases or decreases in net output volume (i.e. the combined output volume of the tracks playing on audio players 10 and 20) during the course of the transition from the outgoing track to the incoming track.

Figure 2:
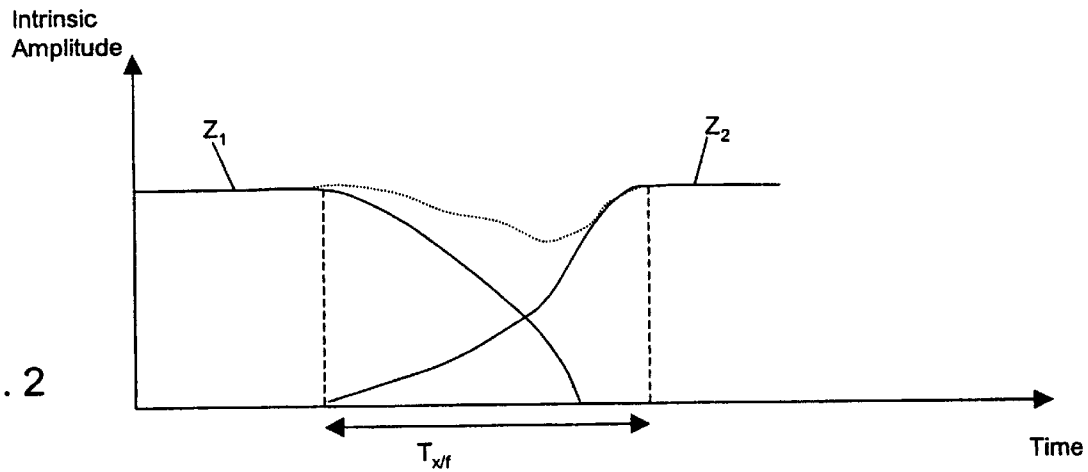
FIG. 2 is a graph of amplitude against time showing the mixing process between two tracks.

Referring now to FIG. 2, a graph of intrinsic recorded amplitude against time is illustrated for two tracks $Z_1$ and $Z_2$ which are to be mixed, in this example the tracks are stored on audio source materials 1 and 2. The intrinsic recorded amplitude is the amplitude of the audio signal stored (in the form of audio data) on the audio source material, so that if the audio signal derived from the audio data were amplified at a constant level throughout its duration, the result would be a corresponding progression of output volume with time. In other words, the intrinsic recorded amplitude of a track may be thought of as corresponding to the volume at which the track was mastered in a studio, and is shown here over the duration of a time period $T_{x/f}$ in which a transition, or cross fade from track $Z_1$ to $Z_2$ is to be made. From the graph it can be seen that the intrinsic amplitude of $Z_1$ drops off relatively suddenly, meaning that if the track is amplified at a constant level during the transition, the output volume of the track will drop correspondingly suddenly. By contrast, the intrinsic amplitude of track $Z_2$ rises more steadily over the course of the time period $T_{x/f}$. To provide a seamless transition, the net output volume (i.e. the combined output volume of the two tracks) over the course of the transition should ideally be substantially constant. In the present illustrated example, if both tracks Z1 and Z2 are amplified at the same constant level over the course of the transition, the net output volume will correspond to the sum of their intrinsic amplitudes, shown by the dashed line L, which as can readily be seen is far from constant. To equalise the net output volume, and preferably to make it substantially constant, it is therefore necessary to adjust either the intrinsic amplitude or the amplification level of at least one, and possibly both of the tracks over the course of the transition phase. According to one aspect of the present invention, equalisation is achieved by analysing at least a part of each of the tracks (in advance of playing the track) over the duration of the transition phase between one track and another, and using the analysis to equalise the net output volume when the track is played.

Figure 3:
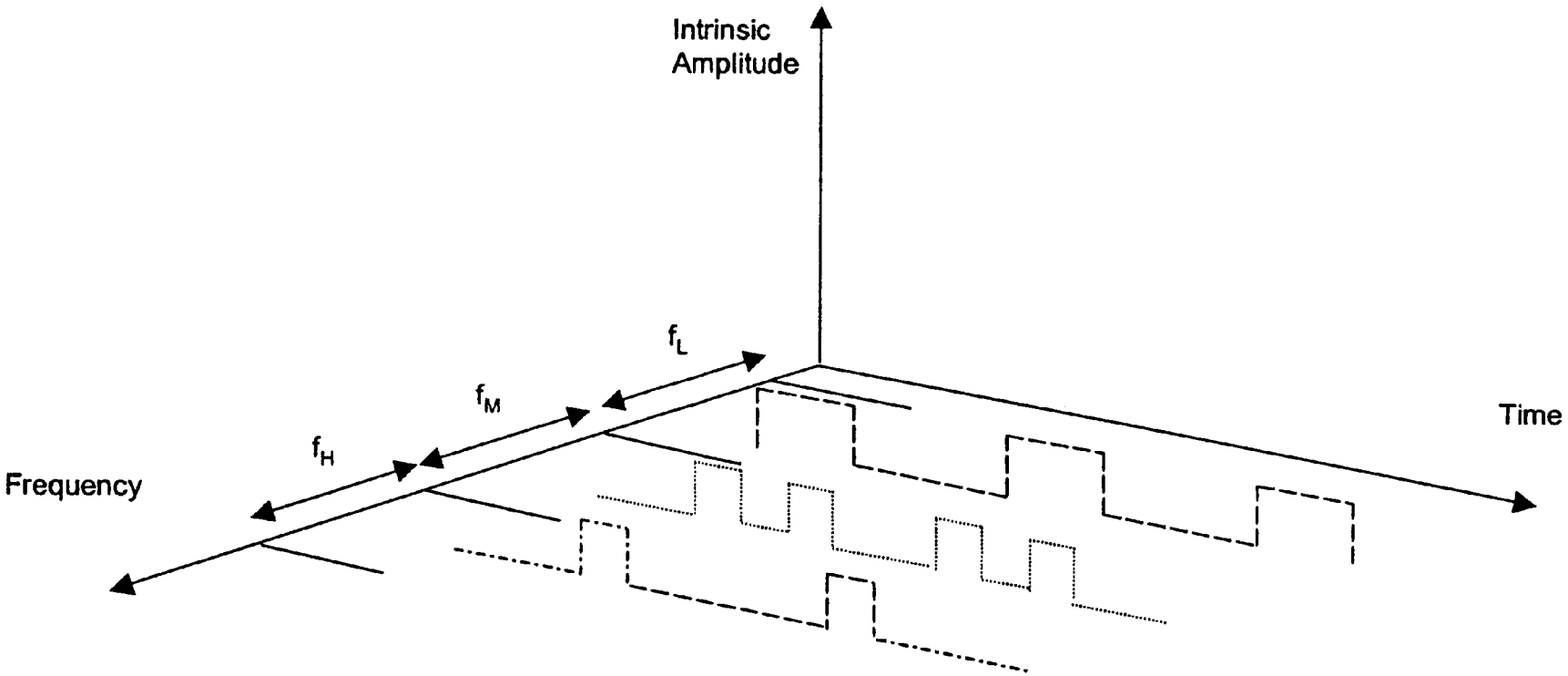
FIG. 3 is a further larger scale graph of amplitude against time which additionally shows frequency information.

Referring now to FIG. 3, variations in the intrinsic amplitude of a small part of the section of track $Z_1$ in which a transition to track $Z_2$ has been chosen to take place are shown in more detail, i.e. with a larger scale and with the frequency information devolved onto a third orthogonal graphical axis, which makes it possible to consider visually the temporal occurrence of different frequency elements independently of each other with relative ease, while still retaining information on the timing between them. FIG. 3 shows three different frequency bands, viz low-frequency elements $f_L$ (e.g. bass lines), mid-frequency elements $f_M$ and high frequency elements $f_H$, although many more may be defined in a practical system, similarly it should be noted that in practice the amplitude signature of a track is likely to be significantly more complex, both in terms of the mixture of frequency components and the variations in intrinsic amplitude of those components than has been illustrated here for purposes of explanation.

Figure 4:
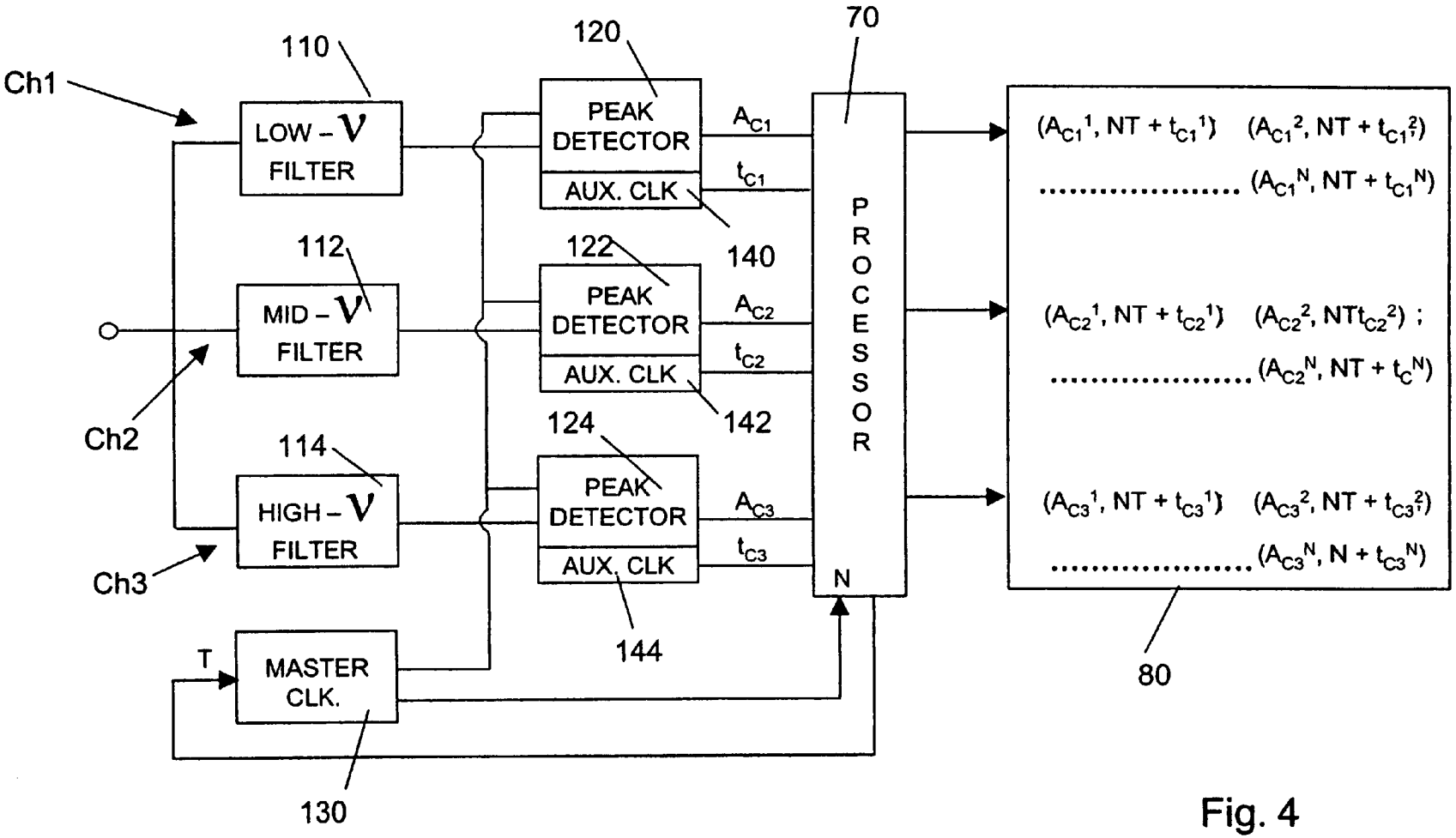
FIG. 4 is a schematic representation of a part of a mixing system according to an embodiment of the present invention.

Referring now to FIG. 4, the architecture of a system for analysing variations in intrinsic amplitude by sampling different frequency bands is illustrated schematically. A digitised audio signal (whether generated intrinsically from a CD, or as a result of conversion from an analogue source) from track $Z_1$ is sampled prior to mixing of the track by using the system of FIG. 4, and is passed through three parallel signal processing channels Ch1 ($f_L$), Ch2 ($f_M$), Ch3 ($f_H$), each of which has a frequency pass-band filter: low pass filter 110, mid pass filter 112 and high pass filter 114 respectively. The outputs of each of the filters 110–114 are sent to a peak detector 120–124 respectively. The peak detectors are each reset periodically by a master clock 130, whose period T is set by processor 70 to equal the beat of the track as determined (at least for the duration of the transition phase between tracks $Z_1$ and $Z^2$) by the time-stretching process described fully in our co-pending European application 00303960.0. The peak detectors 120–124 thus periodically generate an output corresponding to the maximum value of intrinsic amplitude $A_{Cn}$ in the respective frequency range once per beat of the track $Z_1$. In addition, each of the peak detectors 120–124 incorporates an auxiliary clock 140–144 respectively which is reset simultaneously with the peak detector by the master clock 130. The auxiliary clocks provide a time value $t_{Cn}$ indicative of the instant in time over the course of a given cycle of the master clock 130 (and therefore the beat of the track) at which the peak intrinsic amplitude occurred. For a given frequency channel, this time value may well be the same each time, because the peak intrinsic amplitude in any given channel is likely to have a constant relationship in time with the beat of the track, which in turn is typically constant. However, as will be seen subsequently, it is useful in determining relative timing of peaks in different channels.

It is not essential to provide sampled outputs from the individual channels based on peak amplitude. For example, in an alternative configuration an integrating circuit may be used in conjunction with the master clock to provide a series of average amplitude values over the course of each clock cycle.

The sampled outputs from channels Ch1, Ch2, Ch3 are stored in a designated memory MC1, MC2, MC3 respectively (typically provided by designated areas of RAM 80), in a series of what may be thought of as temporal intrinsic peak amplitude coordinates, i.e. comprising a digital intrinsic peak amplitude value, e.g. $A_{C1}$ (typically 16–24 bits long per audio channel) in conformity with current CD and DVD player standards) and a corresponding time value indicating the time elapsed since the start of the transition phase at which that peak intrinsic amplitude occurred. These three sets of coordinates may be represented in visual terms by three histograms, from which a rapid appreciation of the relative intrinsic amplitude and timing of the peaks can be obtained, and in FIGS. 5A and B the histograms for the sections of track $Z_1$ (represented by coordinates $[A_{Cn}^N, (NT+t_{Cn}^N)]$ and $Z_2$ (represented by coordinates $B_{Cn}^N$, $NT+t_{Cn}^N$) which are to be mixed during the transition are shown, where: $A_{Cn}^N$ and $B_{Cn}^N$ are the $N^{th}$ intrinsic peak amplitudes for tracks $Z_1$ and $Z_2$ from Channel $C_n$ at a time $Nt_{Cn}^N$ after the start of the transition phase, N is an integer generated by a processor 200 which increases by a value of 1 for each clock cycle during the sampling, T is the time period equal to the beat of the track, and $t_{Cn}^N$ is the time interval in the $N^{th}$ clock cycle preceding occurrence of the peak amplitude $A_{Cn}^N$ or $B_{Cn}^N$ as the case may be. Using the peak intrinsic amplitude coordinates from each of the channels Ch1–Ch3, a determination is then made by processor 70 as to which frequency range is dominant for the pair of tracks $Z_1$ and $Z_2$ over their mutual transition period. The dominant range will then be used to provide data necessary for equalising the net output volume over the transition phase between the tracks $Z_1$ and $Z_2$. Determination of the dominant range may be made on the basis of one or more predetermined criteria, such as for example, the frequency range in which the average peak intrinsic amplitude is highest over the duration of the transition period between tracks (i.e. the period over which sampling by the signal processing architecture illustrated in FIG. 4 occurred), or the frequency range in which the highest peak was obtained over the duration of the transition period. In the present example the dominant frequency range is chosen to be the one whose intrinsic peak amplitudes have been used to time-stretch and synchronise tracks $Z_1$ and $Z_2$, which in this example is the low frequency range.

Having generated intrinsic amplitude coordinates by sampling the transition section of each track, the coordinates from the dominant channel are then used to provide equalisation of the net output volume. Sampled outputs of the two tracks $Z_1$ and $Z_2$ from the dominant frequency channel which are to occur contemporaneously during the mix are summed together (remembering that the outputs in the low frequency range are synchronised as a result of time stretching and automatic synchronisation in accordance with our co-pending European application 00303960.0) to provide a series of summed contemporaneous values of peak intrinsic amplitude against time, i.e. summed contemporaneous peak amplitude coordinates ($\Sigma A_{Cn}^N B_{Cn}^N$, $NT+t_{Cn}^N$). These summed peak amplitude coordinates are illustrated schematically in the histogram of FIG. 6, from which it can be seen that the variation of summed peak amplitude with time is not constant over the course of the transition phase between tracks, similarly if both tracks are amplified at the same constant level of gain over the course of the transition phase, the net output volume from the speakers will correspond substantially to this variation, and will correspondingly not be constant. The net output volume may be equalised in many ways. Two simple ways in which this can be done is either to vary the amplification of one or both tracks during the transition phase to compensate for the variation of summed peak amplitude, or to adjust the intrinsic amplitude of one or both tracks so that the summed peak amplitude is constant over the transition phase.

To adjust the amplification gain over the transition period, a profile of amplification level or gain with time is generated from the summed peak amplitude coordinates, and is then applied to the two tracks. The amplification profile is generated by taking the amplitude value from each summed peak amplitude coordinate, and comparing it to the relatively constant intrinsic amplitude prior to entering the transition phase (NB any differences in intrinsic "constant" amplitude of the two tracks is normalised prior to mixing, either by an adjustment in amplification gain which is phased-in linearly during the transition phase, or by a modification of the intrinsic amplitude of the incoming track, in this instance $Z_2$). In the current example, the intrinsic amplitude of the channel Ch1 frequency band (or in a different example whichever other frequency band is determined as being dominant) prior to entering the transition phase is equal to a substantially constant value $\alpha$, and the amplification gain q is at a constant value Q. However, at a time NT+t after the start of the transition phase the summed peak amplitude $\Sigma A_{Cn}{}^{N}B_{Cn}{}^{N}$ has dropped below a by an amount $\delta\alpha$, given by the expression $(\Sigma A_{Cn}{}^{N}B_{Cn}{}^{N}-\alpha)$ to the value $(\alpha+\delta\alpha)$. FIG. 6B shows values of $-\delta\alpha$ (i.e. with inverted sign) against time (NB the convention being that $\delta\alpha$ has a sign which is negative if $\Sigma A_{Cn}B_{Cn}$ is less than $\alpha$). The gain at that point in time during the transition phase should be therefore be increased by $\delta\alpha^{N}/(\Sigma A_{Cn}{}^{N}B_{Cn}{}^{N}-\alpha)$ to a value $Q[1-\delta\alpha\Sigma A_{Cn}{}^{N}B_{Cn}{}^{N}]$ in order that the net output volume is equalised to the pre-transition phase level. By comparing each of the summed peak amplitudes $\Sigma A_{Cn}{}^{N}B_{Cn}{}^{N}$ with the value $\alpha$, a series of discrete modified amplification gain levels q, where:

$$q=Q[1-\delta\alpha^{N}/\Sigma A_{Cn}{}^{N}B_{Cn}{}^{N}]$$

against time is generated, which in turn may be used to approximate a continuous profile of amplification gain against time during the course of the transition phase (e.g. by fitting a curve to the discrete values) and this profile is shown in FIG. 6C.

The amplification profile is then applied to the outputs of the two audio players 10, 20 without discrimination as to frequency range (since the output of the players is not naturally split into frequency bands) over the duration of the transition phase. The gain levels specified by the amplification profile may be split between the amplifiers 30, 40 of the audio players 10, 20 in any ratio desired, provided that at any instant the net amplification gain applied to the two tracks $Z_1$, $Z_2$ (i.e. the linear sum of the gain applied to tracks individually) is equal to the amplification gain specified by the profile at that instant. In one embodiment the gain values will be split 50—50 between the two players, so that the fade-out and fade-in of the two tracks as a result of their intrinsic amplitude is replicated in relative terms in the transition phase. Alternatively, the relative intrinsic peak amplitudes of the two tracks during the transition phase may be taken into account, in which case the gain is apportioned between the amplifiers 30, 40 so the fade-out and fade-in is substantially linear. Alternatively the amplification profile is applied to only one track.

Although reference has frequently been made to the use of digital audio players in conjunction with the method and apparatus of the present invention, it is not necessary to use such players for implementation of the invention. For example, amplification could be applied to digital audio of the final mix (or near final mix), and used to produce a final mix audio file that is stored in memory.

Equalisation of the net output volume by modification of intrinsic amplitudes may also be performed using the summed contemporaneous peak amplitude coordinates show n in FIG. 6A. Once again each summed peak amplitude $\Sigma A_{Cn}{}^{N}B_{Cn}{}^{N}$ is compared with the pre-transition phase "constant" level $\alpha$, to generate a value $\delta\alpha^{N}$ equal to the difference between them. As previously, each value $\delta\alpha^{N}$ has a positive sign if the summed peak amplitude $\Sigma A_{Cn}{}^{N}B_{Cn}{}^{N}$ is larger than $\alpha$, and a negative sign if smaller. In the present example each summed peak amplitude $\Sigma A_{Cn}{}^{N}B_{Cn}{}^{N}$ is smaller than $\alpha$, and so each summed peak amplitude must be increased by $(\Sigma A_{Cn}{}^{N}B_{Cn}{}^{N}-\delta\alpha^{N})$ in order to make it equal to $\alpha$. The total increase required in the summed peak amplitude $\Sigma A_{Cn}{}^{N}B_{Cn}{}^{N}$ for equalisation is then apportioned between the individual intrinsic peak amplitudes in proportion to their size, so the $N^{th}$ intrinsic peak amplitude value $A_{Cn}{}^{N}$ will be increased by a value:

$$\Delta_{A}{}^{N}=\delta\alpha^{N}A_{Cn}{}^{N}/(A_{Cn}{}^{N}+B_{Cn}{}^{N})]$$

and the $N^{th}$ intrinsic peak amplitude value $B_{Cn}{}^{N}$ will be increased by a value $$\Delta_{B}{}^{N}=\delta\alpha^{N}B_{Cn}{}^{N}/(A_{Cn}{}^{N}+B_{Cn}{}^{N})]$$

From these absolute values $\Delta_{A}{}^{N}$ and $\Delta_{B}{}^{N}$ of peak amplitude incrementation, a set of proportional reduction values $\Delta_{A}{}^{N}/A_{Cn}{}^{N}$, and $\Delta_{B}{}^{N}/B_{Cn}{}^{N}$ are easily calculable. These discrete proportional reduction values may then be used to approximate a continuous profile of proportional amplitude modification against time (for example by fitting a curve to the points as in the case of the curve of FIG. 6C), which may then in turn be used to modify each intrinsic amplitude value (as opposed simply to the peak intrinsic amplitude values) of the respective track $Z_1$ or $Z_2$ by an amount proportional to its amplitude. Once the intrinsic amplitudes of the tracks $Z_1$ or $Z_2$ have been modified, the tracks may then be mixed simply by maintaining a constant amplification gain on each track throughout the duration of the mix, since equalisation of the net volume has been performed by the creation of the modified amplitude values.

Physical modification of the intrinsic amplitudes involves copying the transition section of each track $Z_1$, $Z_2$ to a RAM, and then modifying the copied version of the transition section which is stored in the RAM. This is feasible, since the maximum frequency of a CD-quality digital audio signal is approximately 22 KHz, and so is sampled at 44.1 KHz in order to capture all the variations in amplitude (i.e. two "values" of amplitude per cycle). If the transition between the tracks lasts for ten seconds, then 0.88 Mb of memory will be required for each track (digital audio usually operating on 16 bits rather than 8), meaning a tot al required RAM capacity of less then 2 Mb.

In a further embodiment of the present invention, equalisation is performed by considering each of the tracks separately. Referring now to FIGS. 7A and 7B, standard fade-out and fade-in amplitude profiles are lines of equal gradient, but opposing sign. From FIG. 7C it can be readily seen that if a pair of tracks having such profiles are mixed together, with the amplification gain remaining constant during the transition phase, the net output volume will be constant. Thus it is possible using these profiles to pre-configure the introduction and play-out parts of a given track to the template so that it will mix with any other track similarly configured. The pre-configuration may be performed either by adjustment of the amplification gain over the course of the transition phase, or modification of the intrinsic amplitude, as described in each case above, so that the fade-out and fade-in sections of a given track correspond to the template profile. This embodiment has been described in connection with substantially linear profiles of amplitude variation with time. Other profiles which sum to provide equalisation may also be employed, and preferably the incoming and outgoing profiles will sum to provide constant or substantially constant output amplitude over the duration of the transition.

In a further modification, a combination of amplification adjustment and modification to intrinsic amplitude may be employed, either to tailor two tracks together individually as described above, or to configure tracks to a template profile.

Figures 8A, 8B, 8C, 8D:
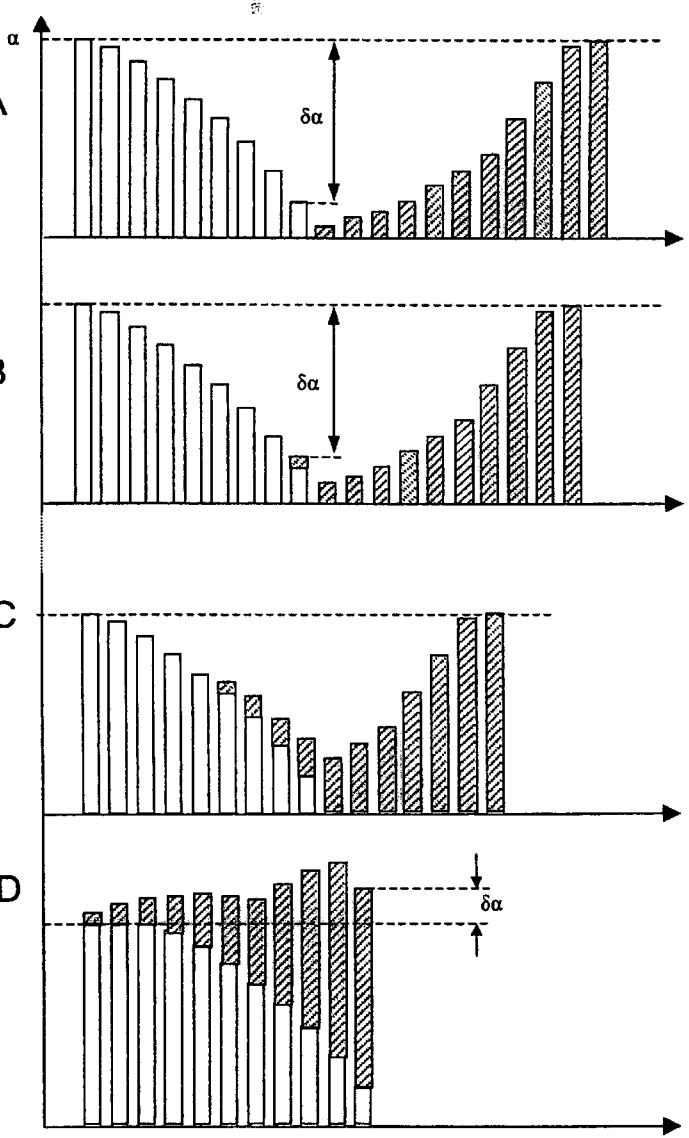

In an alternative embodiment variations in net output volume are minimised by matching sampled fade-out and fade-in sections of two track s in a variety of temporal juxtapositions, i.e. different instances of starting to play the fade-in part of one track simultaneously with the fade-out part of another, and the temporal juxtaposition yielding the smallest variation in net output volume over the duration of the transition is adopted. While this embodiment may not necessarily provide full, or substantially full equalisation, it nevertheless reduces net output volume variations in comparison to what they would otherwise be, and has the virtue of being simple and therefore quicker than the other embodiments. Referring now to FIG. 8A, the sampled peak amplitudes of the sections of tracks $Z_1$ and $Z_2$ which are to be mixed are juxtaposed side by side, i.e. the last value of peak amplitude of $Z_1$ is adjacent the first peak amplitude of $Z_2$. With the tracks $Z_1$, $Z_2$ juxtaposed in such a manner, the processor 70 then performs a comparison in respect of each peak amplitude, to generate a series of values $|\delta\alpha^N|$, where:

$$|\delta\alpha^N|=|\alpha-\Sigma A_{Cn}{}^N B_{Cn}{}^N|$$

Thus $|\delta\alpha^N|$ is the absolute value of the difference between the sum of contemporaneous peak amplitude values, and the value $\alpha$ is established as the substantially constant amplitude prior to the transition phase. In the example illustrated in FIG. 8A there are no summed peak amplitude values, and so the expression $\Sigma A_{Cn}{}^N B_{Cn}{}^N$ is simply equal to the individual peak amplitude in each case. An average $\epsilon_1$ of the values $|\delta\alpha^N|$ is then obtained for the first juxtaposition.

The two sets of peak amplitudes are then re-juxtaposed, with the first and last peak amplitudes of tracks $Z_2$ and $Z_2$ summed together as illustrated in FIG. 8B, and a value $\epsilon_2$ is obtained for that juxtaposition, whereupon the peak amplitudes are re-juxtaposed by one, i.e. moving the peak amplitudes of track $Z_2$ "back in time" by one peak amplitude, and a further value $\epsilon_2$ is obtained for that second juxtaposition. This process is repeated to obtain a value of $\epsilon$ for each possible juxtaposition, i.e. through the juxtaposition illustrated in FIG. 8C until the juxtaposition of FIG. 8D is reached. This yields a series of values of $\epsilon_1, \epsilon_2, \ldots \epsilon_i$, each of which is representative of the variation in intrinsic amplitude (and therefore, for a given level of amplification gain, net output volume) for a particular juxtaposition. The juxtaposition with the most constant intrinsic amplitude will be therefore be the juxtaposition with the lowest value of $\epsilon$, which is thus selected for the transition, and the two tracks are then played in the selected juxtaposition at a constant level of amplification.

A further independent aspect of the present invention relates to a qualitative aspect of providing an appealing mix between two tracks. Referring again to FIG. 5, while the beats of the tracks $Z_1$ and $Z_2$ in the dominant frequency band $f_L$ sampled via channel Ch1 are synchronised for the transition between tracks (this process of synchronisation being performed in accordance with the disclosure of our co-pending European patent application 00303960.0), the other musical elements of the tracks occurring in other frequency bands are unlikely to be so. Thus, depending upon the relative timing of events in these frequency bands, there may be a clash between them, i.e. a combination of events in the same or a similar frequency channel which result in an unappealing mix. To ameliorate such a situation, events from the two tracks in the same or similar frequency bands are matched with each other, that is to say their relative timing and amplitude are compared, and one or more predetermined decision making criteria are applied to the compared events to determine whether a clash is present.

Referring once again to FIGS. 5A and 5B, each of the sampled peak amplitudes from each of the output channels Ch1–3 have a temporal coordinate $NT+t_{Cn}$, where, as referenced above, N is the number of clock cycles (a single clock cycle being equal to the time period of a beat of the two tracks $Z_1$ and $Z_2$ once time-stretched), and $t_{Cn}{}^N$ is the time interval between the start of a clock cycle and the generation of the $N^{th}$ peak amplitude in channel n. It is therefore possible to determine the relative timing of two peak amplitudes in e.g. the high frequency channel Ch3 from tracks $Z_1$ and $Z_2$, since each peak amplitude output from each of tracks $Z_1$ and $Z_2$ in channel Ch3 has a temporal coordinate related to the master clock cycle by the iteration integer N, and the time interval $t_{C3}{}^N$. Peak amplitudes from the non-dominant output channels having equivalent frequency bands are therefore compared from the point of view of relative timing and amplitude in order to determine, on the basis of one or more predetermined criteria, whether they are likely to cause a clash. The determinative criteria may be for example whether their amplitude are similar to within a predetermined value, and whether they occur within a predetermined time interval of each other. In the event that a clash is deemed likely, a number of remedial processes are possible. A first such process requires an amplifier for each of the tracks $Z_1$, $Z_2$ which enables independent amplification levels for different frequency bands, in which case the processor 70 operates to reduce the amplification level of the relevant output channel for one of the tracks; if desired the processor also operates to increase correspondingly the amplification level of the relevant output channel on the other to compensate. Alternatively, a modification of the intrinsic amplitudes may be performed to reduce the amplitude levels for one of the tracks, and if desired to increase amplitudes on the other of the tracks.

Preferably, in the event that this frequency blending technique is to be employed in a system also employing techniques to equalise net output volume, the volume equalisation processing is performed first, so that any effect this may have on the output volume of elements from a given non-dominant frequency band may be taken into account, both in determining whether a clash is likely to occur, and in modifying output volumes for musical elements in a particular frequency band.

As mentioned previously in connection with FIG. 3, the variation of intrinsic amplitude of a track is, in practice, likely to be significantly more complex than that shown for the purposes of explanation in FIG. 3. Two more realistic examples of variations in intrinsic amplitude are shown in FIGS. 9A and B. One result of the significantly greater complexity which exists in practice is that sampling the tracks using channels having fixed and predetermined frequency bands is unlikely to provide optimum results for each track. For example the dominant bass line of a particular track, which is most frequently used both for time stretching and determining adjustments for equalisation of output amplitude, may have a frequency which straddles two of the predetermined fixed frequency bands, meaning that variations of amplitude at this frequency would be sampled partly in the low frequency channel and partly in the mid-frequency channel. To provide optimum equalisation in each case, a preferred embodiment of the present invention provides that following copying of a section of each of the tracks selected for mixing into RAM, the tracks are analysed to determine, from the variation in amplitude across the analysed spectrum of frequencies of both of the tracks an appropriate number and range of frequency bands. Thus the frequency and range of the bands, and therefore the number of them, may vary from one crossfade to another. Selection of bands is typically performed initially for an individual track, by considering the intrinsic amplitude over the time selected for mixing. For this time interval, a provisional frequency band is assigned for each peak amplitude above a given value, and which is spaced by more than a predetermined frequency range from another such peak. This process is repeated for the second of the two tracks to be mixed, and the two sets of provisional designated frequency bands (and the variations in amplitude within them) for the two tracks are then compared. From the comparison of the two provisional sets of bands, at least one common dominant frequency band, to be used for equalisation purposes is defined, typically by selecting the two most individually dominant provisional frequency bands which lie within a predetermined frequency range of each other, and then defining a common frequency band which encompasses the peak amplitudes of the two provisional bands. Further common frequency bands may be defined for the purpose of preventing clashes if desired.

Clashes may however be prevented without defining further frequency bands. For example, to provide the maps of FIGS. 9A and B, the entire section of each track selected for the crossfade will have been copied into RAM. It is therefore possible simply to compare each peak amplitude of one track with nearby peak amplitudes of the other, and determine on the basis of each comparison, whether a clash is likely to occur between the two peaks; if one is, then one of the peaks is reduced until the clash is avoided. The criteria for determining the possibility of a clash are typically as set out above: i.e. whether two peak amplitudes are similar to within a predetermined amplitude value, whether they occur within a predetermined time interval of each other, and whether they occur within a predetermined frequency range of each other (this latter criterion being additional as a result of not considering peak amplitudes in frequency bands).

Referring now to FIG. 10, a peak amplitude P of the outgoing, and in this example dominant track is illustrated graphically. The peak amplitude P has an amplitude A, a frequency $\nu$, and occurs at time $\tau$. A box whose geometric centre is at the coordinates $(A, \nu, \tau)$, and whose dimensions are $\Delta A \times \Delta\nu \times \Delta\tau$, defines the zone within amplitude/frequency/time space within which the occurrence of a peak amplitude from the incoming track would constitute a clash. A peak amplitude P from the incoming track is illustrated in dotted lines. It can be seen that this peak lies within the box and therefore is likely, in accordance with the selected criteria, to cause a clash. The processor therefore reduces the amplitude of this peak until it no longer lies within the box to avoid a clash. This process is repeated for all peak amplitudes outside of the frequency band which is dominant (i.e. which has been used for equalisation), preferably after equalisation has been performed. The dominant track is simply the track which is selected as the track in relation to which clashes will be defined, as opposed to the track whose peak amplitudes are to be suppressed.

It is possible that the reduction in peak amplitude could take an amplitude from one box and into another, thus causing a further reduction in the peak amplitude, which could in theory result in an iterative reduction of some frequencies to negligible (i.e. non audible) levels, it is necessary either to restrict the number of iterations of the process described above, or to stop the process once the non-dominant amplitudes have dropped below a predetermined level.

Analysis of the response of the human ear to different frequencies has shown that, over the range of audible frequencies, the ear is more responsive to some frequencies than others. Thus an audio signal having a constant output volume, whose frequency increases steadily to sweep through the spectrum of audible frequencies, will seem to a listener to be louder at some frequencies in the audible range than others (see for example "The Computer Music Tutorial, Curtis Roads, MIT Press 1998, pp. 1049–1069). In a modification of the technique described above therefore, the sizes of the boxes in amplitude-frequency-time space are weighted in accordance with the established response of the ear. That is to say that at frequencies which the ear is less responsive the boxes are smaller (i.e. a clash between two signals is considered likely only if they are extremely similar), and vice versa.

The range of amplitudes, frequencies and the time interval which define a clash between two peak amplitudes from different tracks have been defined above using Cartesian coordinates, and so boxes within frequency-amplitude-time space have naturally resulted. This is merely for convenience, and any boundary conditions for clashes deemed most appropriate may be defined. Thus for example it is perfectly feasible to define a range of frequencies within which a clash may occur, which range varies with variations in amplitude and time, resulting in e.g., a sphere in frequency-amplitude-time space which defines a clash.

The methods described thus far have all related to analysis and processing of the audio data which occurs prior to playing. It is however possible to perform a degree of equalisation in real time. For example, using a simplified version of the apparatus of FIG. 4 to sample the output amplitude of the audio sources (i.e. the amplitude after amplification), values of peak output amplitude for each track can be generated which can be compared to values of desired output amplitude from a predetermined amplitude profile, such as the ones illustrated in FIGS. 7A and B, and an instantaneous adjustment to the amplification of the track can be made on the basis of the comparison, in order to cause the output amplitude of each track to conform substantially to the predetermined profiles.

What is claimed is:

1. A method for automated mixing of at least two pieces of musical content comprising the steps of:

selecting first and second sections of first and second tracks respectively, over which transition between playing the first and second tracks will be made;

analysing intrinsic recorded amplitude of the first and second tracks over the first and second sections respectively;

simultaneously playing the first and second sections of the first and second tracks;

effecting the transition from playing the first track to playing the second track by reducing output amplitude of the first track over duration of the first section and increasing output amplitude of the second track over duration of the second section; and using analysis of the intrinsic recorded amplitude of at least one of the first and second tracks to equalise variations in net output volume from the first and second tracks over the duration of the transition.

2. The method according to claim 1, wherein the using step equalises variations in net output volume from the first and second tracks over the duration of the transition to provide a substantially constant net output amplitude over the duration of the transition.

3. The method according to claim 1 wherein the using step also includes the step of adjusting amplification of at least one of the first and second tracks over the duration of the transition.

4. The method according to claim 3 further comprising the step of generating a profile of amplification with time for at least one of the first and second tracks over the duration of the transition.

5. The method according to claim 4 wherein the generating step includes pairing at least selected intrinsic amplitude values of at least one of the first and second tracks with further amplitude values, and determining, for each paired intrinsic amplitude value, a value of amplification required to generate from the selected intrinsic amplitude value, a target output amplitude.

6. The method according to claim 5 wherein the further amplitude values form a template profile of predetermined amplitude with time, and the target output amplitude corresponds to a contemporaneous amplitude of the template profile.

7. The method according to claim 6 wherein the further amplitude values are contemporaneous intrinsic amplitudes of the other of the first and second tracks, and a combined target output amplitude of the first and second tracks has a predetermined constant value.

8. The method according to claim 1 wherein the using step also includes the step of creating modified intrinsic amplitude values for at least one of the first and second tracks over the duration of the transition.

9. The method according to claim 8 further comprising the steps of:

generating a copy of at least one of the sections of one of the first and second tracks over which the transition will be made;

modifying at least one intrinsic amplitude value from the copy to generate a modified copy; and, amplifying the modified copy during the transition.

10. The method according to claim 9 further comprising the steps of:

pairing at least selected intrinsic amplitude values of the copy with contemporaneous amplitude values from a template profile of amplitude with time; and modifying amplitude values from the copy so that the amplitude values are equal to the contemporaneous values from the template profile.

11. The method according to claim 9 further comprising the steps of:

summing a plurality of contemporaneous intrinsic amplitude values of the first and second tracks over the duration of the transition, to generate sets of contemporaneous summed amplitudes; and normalising each of the sets of contemporaneous summed amplitudes so that the sum is equal to a predetermined constant amplitude, by modifying the intrinsic amplitude values of the copy of at least one of the first and second tracks.

12. The method according to claim 11 wherein copies of both the first and second sections of the first and second tracks are generated, and the step of normalising each set of contemporaneous summed amplitudes is achieved by modifying the intrinsic recorded amplitude values of each of the copies of the first and second tracks.

13. The method according to claim 11 further comprising the step of providing a constant and predetermined level of amplification to both the first and second tracks over the duration of the transition from playing of the first track to playing of the second track.

14. The method according to claim 1 wherein the using step also includes the step of adjusting amplification of at least one of the first and second tracks over duration of the transition, and the step of creating modified intrinsic amplitude values for at least one of the first and second tracks over the duration of the transition.

15. The method according to claim 1 further comprising the steps of:

generating an indication of variation in output amplitude for a plurality of temporal juxtapositions for simultaneous playing of the first and second tracks;

selecting a temporal juxtaposition of the plurality of temporal juxtapositions having the lowest indicated variation in output amplitude; and, effecting transition from the first track to the second track by playing the first and second tracks in the temporal juxtaposition selected in the selecting step.

16. The method according to claim 15 wherein the step of generating also includes comparing a series of summed amplitude values of the first and second tracks to a predetermined amplitude level.

17. The method according to claim 16 wherein the indication of variation in output amplitude for a given temporal juxtaposition is an average of difference between each of the series of summed amplitude values and the predetermined amplitude level.

18. The method according to claim 1 wherein the using step takes place in real time.

19. The method according to claim 18 further comprising the steps of:

sampling the output amplitude of the first and second tracks, resulting in sampled output amplitude;

comparing the sampled output amplitude to a template profile of output amplitude with time; and adjusting amplification of at least one of the first and second tracks in accord with a result of the comparing step.

20. The method according to claim 1 further comprising the step of defining for the first and second tracks, at least one frequency band, subsequent to the analysing step.

21. The method according to claim 5 further comprising the step of defining for the first and second tracks, at least one frequency band, subsequent to the analysing step, wherein the selected intrinsic amplitude values are selected from within the at least one frequency band.

22. The method according to claim 11 further comprising the step of defining for the first and second tracks, at least one frequency band, subsequent to the analysing step, wherein the contemporaneous intrinsic amplitude values lie within the at least one frequency band.

23. An apparatus for equalising output amplitude of first and second sections of musical content intended for simultaneous output, the apparatus comprising:

first and second audio data sources on which the first and second sections of the musical content are stored;

first and second music players, adapted to generate first and second audio signals from the first and second audio data sources respectively;

an amplifier for amplifying the first and second audio signals;

an analyser, adapted to analyse at least the first and second audio signals, and to determine an extent of variation between a constant value and a combined intrinsic amplitude of the first and second audio signals resulting from simultaneous playing of the first and second audio signals.

24. The apparatus according to claim 23 wherein the analyser is additionally adapted to generate, on the basis of the extent of variation an amplification profile for each of the first and second audio signals, in accordance with which the first and second audio signals will be amplified, thereby to equalise output amplitude during simultaneous playing of the first and second audio signals.

25. The apparatus according to claim 24, wherein the analyser includes a memory in which copies of the first and second audio signals are stored prior to playing.

26. The apparatus according to claim 25, wherein the analyser is adapted to modify, prior to playing, intrinsic amplitudes of at least one of the first and second audio signals stored in the memory, in accordance with the extent of variation.

27. The apparatus according to claim 23, wherein the analyser is adapted to generate an error profile indicating a variation from the constant value of the combined intrinsic amplitude with time, and further wherein the error profile is used by the analyser to generate an amplification profile for each of the first and second audio signals, in accordance with which the first and second audio signals will be amplified, thereby to equalise output amplitude during simultaneous playing of the first and second audio signals.

28. The apparatus according to claim 23, wherein the analyser is adapted to generate an error profile indicating a variation from the constant value of the combined intrinsic amplitude with time, and further wherein the error profile is used by the analyser to modify, prior to playing, intrinsic amplitudes of at least one of the first and second audio signals stored in the memory, in accordance with the extent of variation of the combined intrinsic amplitude from the constant value.

29. The apparatus according to claim 23, wherein the analyser is adapted to sample the first and second audio signals during playing, to compare an instantaneous output amplitude of each of the first and second audio signals with a predetermined profile of output amplitude variation with time, and to alter amplification of at least one of the first and second audio signals in accordance with the results of each comparison.

* * * * *